US007346294B2

(12) United States Patent
Lee

(10) Patent No.: US 7,346,294 B2
(45) Date of Patent: Mar. 18, 2008

(54) IMAGE FORMING APPARATUS TO REMOVE JAMMED PAPER

(75) Inventor: Bong-hee Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 322 days.

(21) Appl. No.: 11/248,129

(22) Filed: Oct. 13, 2005

(65) Prior Publication Data

US 2006/0083546 A1 Apr. 20, 2006

(30) Foreign Application Priority Data

Oct. 18, 2004 (KR) ..... 10-2004-0082957

(51) Int. Cl.
*G03G 21/00* (2006.01)

(52) U.S. Cl. ..... 399/124

(58) Field of Classification Search ..... 399/9, 399/18, 21, 22, 107, 110, 124, 125
See application file for complete search history.

(56) References Cited

U.S. PATENT DOCUMENTS 6,978,097 B2 * 12/2005 Ozawa et al. ..... 399/88
7,031,639 B2 * 4/2006 Masuda et al. ..... 399/124
7,233,754 B2 * 6/2007 Kida ..... 399/124

FOREIGN PATENT DOCUMENTS

| | | |
|---|---|---|
| JP | 3-148684 | 6/1991 |
| JP | 2003-186371 | 7/2003 |
| JP | 2003-330239 | 11/2003 |
| JP | 2004-29271 | 1/2004 |
| KR | 2004-18719 | 3/2004 |

* cited by examiner

*Primary Examiner*—Hoan Tran
(74) *Attorney, Agent, or Firm*—Stanzione & Kim, LLP

(57) ABSTRACT

An image forming apparatus includes a main body frame, an image forming unit disposed inside of the main body frame to form an image, a door unit disposed in such a manner to make a conjoin rotation to thereby approach to a paper transfer path disposed inside of the main body frame, a roller assembly disposed on the paper transfer path, and an opening and closing coupling unit to couple the door unit with the roller assembly, wherein the roller assembly is opened/closed when the door unit is opened/closed.

20 Claims, 3 Drawing Sheets

IMAGE FORMING APPARATUS TO REMOVE JAMMED PAPER

CROSS-REFERENCE TO RELATED APPLICATIONS

This application claims the benefit under 35 U.S.C. § 119(a) from Korean Patent Application No. 2004-82957, filed on Oct. 18, 2004, in the Korean Intellectual Property Office, the entire content of which is incorporated herein by reference.

BACKGROUND OF THE INVENTION

1. Field of the Invention

The present general inventive concept relates to an image forming apparatus and more particularly, to an image forming apparatus capable of easily removing sheets of jammed paper therefrom.

2. Description of the Related Art

An image forming apparatus, such as a printer, a photocopier, a facsimile machine, etc., generally picks up a sheet of paper placed in a paper feeding unit by using a pick-up roller and transfers the sheet of paper to an image forming unit which has a development unit and a photosensitive medium. In the image forming unit, an image formed on the photosensitive medium by the toner is transferred onto the sheet of paper transported through a paper transfer path to a fixing unit, where the toner image is fixed onto the sheet of paper. The sheet of paper is subsequently discharged to a designated tray through a paper discharge unit.

While the sheet of paper is transported through the paper transfer path, the sheet of paper is occasionally crumpled or distorted. This situation is generally called a paper jamming situation. The paper jamming situation may occur in the course of picking up, transporting or discharging sheets of paper.

When the paper jamming phenomenon occurs, a user is compelled to remove the jammed sheet of paper. However, in a conventional image forming apparatus, it is difficult for a user to find the place where the sheet of paper is jammed, and when the paper jamming situation occurs at multiple locations within the image forming apparatus, the user has to open each of several openings/closings to find the jammed sheets of paper and then to remove the jammed sheets of paper.

To improve the efficiency of the removal of the jammed sheets in an image forming apparatus, Japanese Publication No. 2003-186371 issued to Takahashi Mitsuru and Kato Tsutomu on Jul. 4, 2003, entitled "Image Forming Apparatus" discloses an image forming apparatus having a large door unit that opens the entire section of a paper transfer path from a paper feeding roller to a paper discharge roller. However, the proposed solution is disadvantageous in that the door unit is too large and heavy, and thus making opening and closing the door unit difficult. Particularly, in case of an image forming apparatus capable of both-sided printing, a return unit is generally attached to the door unit, and as a result, the door unit becomes heavier.

Further, in Japanese publication No. 2003-330239 issued to Nakazato Yasufumi on Nov. 19, 2003, entitled "Image Forming Apparatus," an image forming apparatus enabled with both-sided printing is discussed. Herein, although the size of the door unit is appropriate, an additional opening/closing unit and a holder for opening the paper discharge unit are required in the case that a sheet of paper is jammed along the paper transfer path. In this case, it is inconvenient for a user to maneuver this additional opening/closing unit coupled with the door unit.

SUMMARY OF THE INVENTION

The present general inventive concept provides an image forming apparatus that allows a user to remove a jammed sheet of paper easily. The present general inventive concept also provides an image forming apparatus capable of opening almost entire sections of a paper transfer path by a one step maneuver.

Additional aspects and advantages of the present general inventive concept will be set forth in part in the description which follows and, in part, will be obvious from the description, or may be learned by practice of the general inventive concept.

The foregoing and/or other aspects of the present general inventive concept are achieved by providing an image forming apparatus including a main body frame, an image forming unit disposed inside of the main body frame to form an image, a door unit disposed to make a conjoint rotation to thereby approach a paper transfer path disposed inside of the main body frame, a roller assembly disposed on the paper transfer path, and an opening and closing coupling unit to couple the door unit with the roller assembly. Herein, the roller assembly may be opened when the door unit is opened and may be closed when the door unit is closed. Therefore, it is easy for a user to have an access to the paper transfer path and easily remove sheets of paper that are jammed.

The door unit may be disposed at a sidewall of the main body frame.

The opening and closing coupling unit may include a sliding member to slide in a horizontal direction; and a rotation member connected with the sliding member to make a conjoint rotation in a vertical direction. Herein, the rotation member may include a horizontal rotation bar connected with the sliding member and a vertical rotation bar in contact with the roller assembly.

The image forming apparatus may further include a return unit disposed at an inner wall of the door unit to return a sheet of paper to be printed on both sides. The return unit may have an integral structure with the door unit.

The image forming apparatus may further include a pressurizing protrusion disposed on the inner wall of the door unit to pressurize the opening and closing coupling unit. A hinge unit may connect the roller assembly with the main body frame and can pressurize the opening and closing coupling unit by a load.

According to the present general inventive concept, since the entire section of the paper transfer path can be opened by an opening and closing of the door unit, a user is able to have an easier access to the paper transfer path and can remove sheets of jammed paper conveniently.

The foregoing and/or other aspects of the present general inventive concept may also be achieved by providing an image forming apparatus including a body, a paper transfer path comprising a substantially inclined segment and a substantially horizontal segment to feed a recording medium therethrough, a body door to open and close conjointly with the body to expose the substantially inclined segment of the paper transfer path, and an opening and closing unit to expose the substantially horizontal segment of the paper transfer path when the body door is opened.

The foregoing and/or other aspects of the present general inventive concept may be also achieved by providing a method of exposing a paper transport path of an image forming apparatus, the method including opening a body door to expose a substantially inclined segment of the paper transfer path, and exposing a substantially horizontal segment of the paper transfer path by moving an opening and closing unit when the body door is open.

The foregoing and/or other aspects of the present general inventive concept may be also achieved by providing an image forming apparatus housing including a paper transfer path having a substantially inclined portion to feed a recording medium from a lower portion of the housing to an upper portion of the housing and a substantial horizontal portion, a door to open conjointly with the housing to expose the substantially inclined portion of the paper transfer path, and a roller assembly unit that rotates to expose the substantially horizontal portion of the paper transfer path when the door is opened.

The foregoing and/or other aspects of the present general inventive concept may be also achieved by providing an image forming apparatus having a plurality of paper transfer paths, the apparatus including a plurality of exposing members to expose an associated one of the paper transfer paths, and an opening and closing unit to operate at least one of the plurality of exposing members to expose the associated one of the plurality of paper transfer paths when another one of the plurality of exposing members is operated to expose the associated one of the plurality of paper transfer paths.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
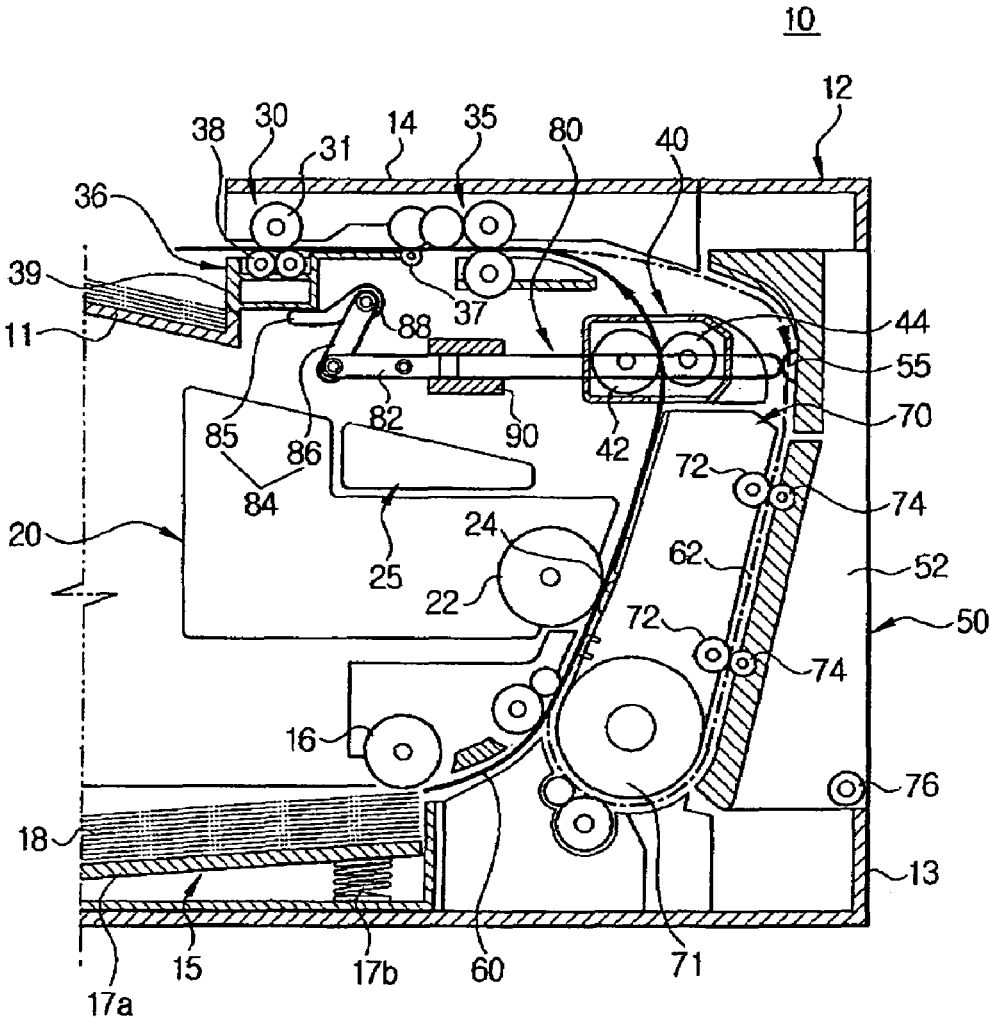
FIG. 1 is a cross-sectional view illustrating an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a cross-sectional view illustrating an image forming apparatus 10 according to an embodiment of the present general inventive concept. The image forming apparatus 10 includes a main body frame 12, a paper feeding unit 15, an image forming unit 20, a paper discharge unit 30, a fixing unit 40, a door unit 50, a return unit 70, and an opening and closing coupling unit 80.

The main body frame 12 is a frame that forms an outer wall of the image forming apparatus 10 and protects various components including the image forming unit 20 installed inside of the image forming apparatus 10. As illustrated in FIG. 1, the door unit 50 is disposed on a sidewall 13 of the image forming apparatus 10, and a paper discharge tray 11 on which discharged sheets of paper are stacked is placed on a portion of an upper wall 14.

The paper feeding unit 15 includes a paper tray 17*a* on which sheets of paper 18 are stacked, and a spring 17*b* to provide an elastic support to the paper tray 17*a*. A pick-up roller 16 picks up the sheets of paper 18 individually, and the individually picked-up sheets of paper 18 are transported along a paper transfer path 60.

The image forming unit 20 includes a developer cartridge (not shown) with developers and a photosensitive drum 22. On a surface of the photosensitive drum 22, an electrostatic image is formed by a laser scanning unit (LSU) 25. The photosensitive drum 22 is installed on the paper transfer path 60 such that the photosensitive drum 22 faces a transcription roller 24. The fixing unit 40 fixes a printed developer onto a sheet of paper by applying heat and pressure to the sheet of paper. Particularly, the fixing unit 40 includes a heating roller 42 and a pressurizing roller 44.

The return unit 70 is disposed at an inner side of the door unit 50 and includes a transfer roller 71 and a plurality of return rollers 72. Along a paper return path 62, the sheet of printed paper is returned for printing the other side of the sheet of the printed paper. Although according to the present embodiment, the return unit 70 forms an integral structure with the door unit 50, it is possible to configure the return unit 70 separately from the door unit 50.

Figure 2:
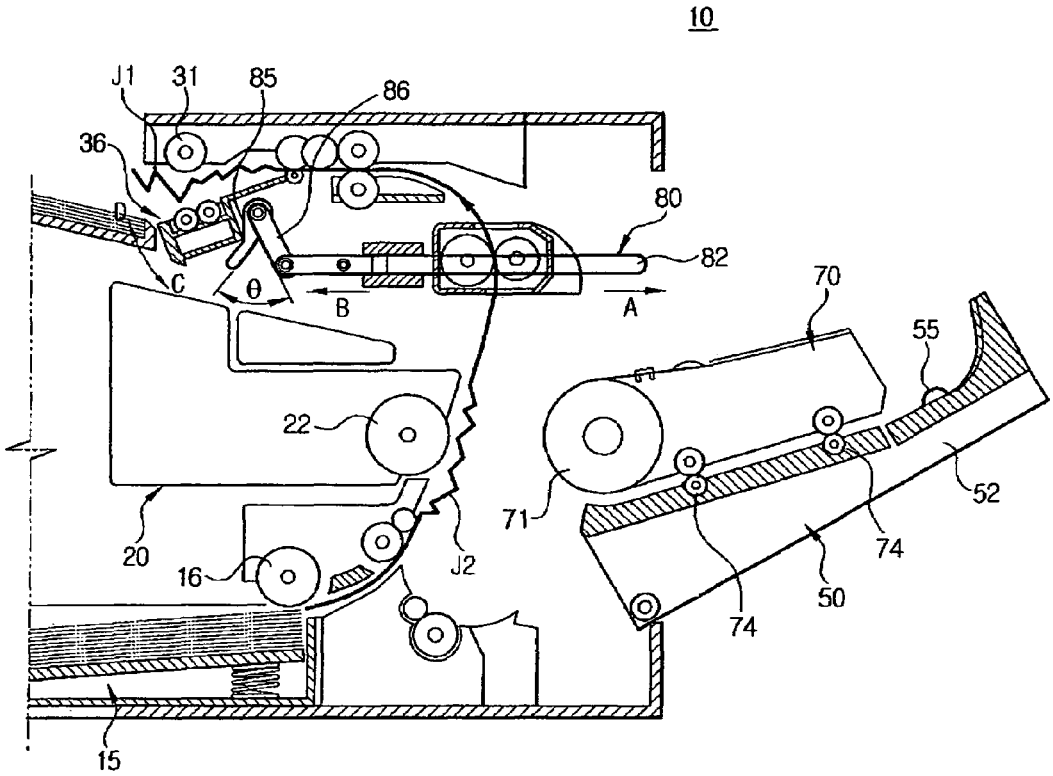
FIG. 2 is a cross-sectional view illustrating the door unit of the image forming apparatus of FIG. 1 in an open state.

As illustrated in FIGS. 1 and 2, the paper discharge unit 30 is disposed at an exit portion of the paper transfer path 60, and includes a paper discharge roller 31 and a roller assembly 36. The roller assembly 36 includes two backup rollers 38 and a roller assembly frame 39. The two backup rollers 38 rotate in a coupling manner with the paper discharge roller 31, and are disposed on the paper transfer path 60. Therefore, when the paper discharge roller 31 performs a forward rotation, the sheet of printed paper is discharged to the paper discharge tray 11. In contrast, if the paper discharge roller 31 performs a reverse rotation, the sheet of printed paper is transported in a reverse direction, away from the paper discharge tray 11. The roller assembly frame 36 encases the backup rollers 38 to provide protection thereto and is attached to a hinge unit 37 of the main body frame 12 to provide a conjoint rotation. The opening and closing coupling unit 80 supports the roller assembly frame 36. The roller assembly 36 does not have a specific locking member for maintaining a position at which the roller assembly 36 engages with the paper discharge roller 31. Hence, when the roller assembly 36 is not supported by the opening and closing coupling unit 80, the roller assembly 36 opens the paper transfer path 60 at the paper discharge unit 30 as the roller assembly 36 rotates by a load. This opening of the paper transfer path 60 by the roller assembly 36 is illustrated in FIG. 2.

With reference to FIGS. 1 and 2, the door unit 50 is attached to the sidewall 13 of the main body frame 12 by a door hinge 76 such that the door unit 50 can rotate around the door hinge to open or close. The return unit 70 is disposed at an inner side of the door unit 50. The door unit 50 includes a door 52, a plurality of tension rollers 74, and a pressurizing protrusion 55. The plurality of tension rollers 74 protrude from an inner wall of the door 52 and rotate as they engage with the respective return rollers 72. The pressurizing protrusion 55 also protrudes from the inner wall of the door 52 and pushes one side of the opening and closing coupling unit 80 to make the opening and closing coupling unit 80 move when the door unit 50 is opened or closed. The paper return path 62, along which a sheet of paper is returned, is disposed between the return unit 70 and the door unit 50. The door unit 50 covers the paper transfer path 60 approximately from the pick up roller 16 to the fixing unit 40. As illustrated in FIG. 2, when the door unit 50 is opened, a large portion of the paper transfer path 60 is exposed.

The opening and closing coupling unit 80 includes a sliding member 82 and a rotation member 84. Also, the opening and closing coupling unit 80 is disposed above the image forming unit 20 and is supported by the main body frame 12. Particularly, the sliding member 82 is supported by a guide unit 90 installed on the main body frame 12, and one side of the sliding member 82 moves freely in a horizontal direction when pushed by the pressurizing protrusion 55 of the door unit 50. The rotation member 84 can include a vertical rotation bar 85 and a horizontal rotation bar 86. One side of the horizontal rotation bar 86 is connected with the sliding member 82 in such a manner to be rotatable, and the other side of the horizontal rotation bar 86 is fixed at the main body frame 12 along with the vertical rotation bar 85 through use of a fixation joint 88 (see FIG. 1). Therefore, as illustrated in FIG. 2, an angle θ between the vertical rotation bar 85 and the horizontal rotation bar 86 is maintained constant. When the sliding member 82 moves horizontally, the horizontal rotation bar 86 connected with the sliding member 82 rotates and the vertical rotation bar 85 rotates vertically, i.e., in upward or downward directions, by maintaining a certain constant angle. Through these horizontal and vertical rotations, the roller assembly 36 moves freely in upward and downward directions.

Figure 3:
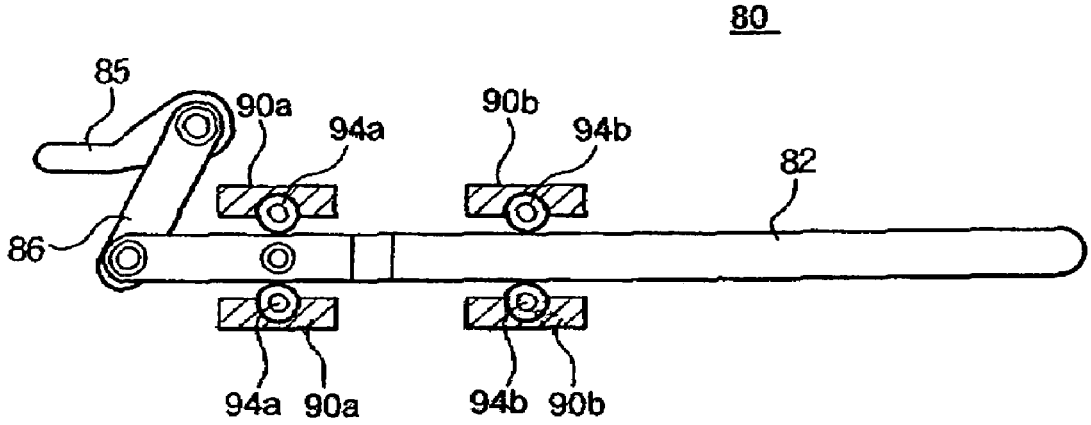
FIG. 3 is a diagram showing major components of an opening and closing coupling unit according to another embodiment of the present general inventive concept.

FIG. 3 is a diagram illustrating another embodiment of an opening and closing coupling unit 80'. Referring to FIG. 3, idle rollers 94*a* and 94*b* are connected respectively with two guide members 90*a* and 90*b* to support horizontal movements of the opening and closing coupling unit 80'. The idle rollers 94*a* and 94*b* protrude inwardly at both sides of the respective individual guide members 90*a* and 90*b* to support the opening and closing coupling unit 80'. Thus, when the opening and closing coupling unit 80' moves, the idle rollers 94*a* and 94*b* also rotate. The guide members 90*a* and 90*b* and the idle rollers 94*a* and 94*b* of FIG. 3 may constitute the guide unit 90 of FIG. 1.

Hereinafter, an operation of the above described configuration elements is explained in detail.

When an image forming signal is input to the image forming unit 20, an electrostatic image is formed on the photosensitive drum 22 by the laser scanning unit 25. Then, a developer is transported to a surface of the photosensitive drum 22 and subsequently forms an image on the surface of the photosensitive drum 22. The pick-up roller 16 then picks up a sheet of paper and transports the sheet of paper to the paper transfer path 60. As the transported sheet of paper passes through a space created between the photosensitive drum 22 and the transcription roller 24, the image formed on the photosensitive drum 22 is transferred onto the transported sheet of paper.

Afterwards, as the sheet of paper passes through the fixing unit 40, a developer is fixed onto the sheet of paper by heat and pressure applied thereto. In case of one-sided printing, the sheet of paper passes through a forward and reverse conjoint rotation control unit 35 and is discharged to the paper discharge tray 11 by the paper discharge unit 30. In case of both-sided printing, the paper discharge roller 31 makes a reverse rotation, and then the sheet of paper returns through the paper return path 62.

Because of various reasons such as poorly arranged sheets of paper and abnormally transported sheets of paper, as illustrated in FIG. 2, a paper jamming situation may occur along the paper transfer path 60 during the transportation of the sheets of paper. Locations J1 and J2 are places where the sheets of paper more commonly may become jammed due to the above-mentioned causes. Thus, when the paper jamming situation occurs, a user first opens the door unit 50. Once the door unit 50 is opened, the opening and closing coupling unit 80 that is supported by the pressurizing protrusion 55 protruded from the inner wall of the door unit 50 becomes released, and thus the sliding member 82 of the opening and closing coupling unit 80 moves towards the door unit 50, specifically, in a direction indicated by an arrow A as illustrated in FIG. 2. Then, the horizontal rotation bar 86 connected with the sliding member 82 rotates in a direction of the door unit 50, and as a result of this rotation, the vertical rotation bar 85 supporting the roller assembly 36 starts rotating.

As the vertical rotation bar 85 rotates, the roller assembly 36 is released and, because of a weight load of the roller assembly 36 itself, the roller assembly 36 starts rotating around the hinge unit 37 attached to the main body frame 12 in a counterclockwise direction, specifically in a direction of an arrow C as illustrated in FIG. 2. This counterclockwise rotation of the roller assembly 36 opens the paper transfer path 60 disposed beneath the paper discharge roller 31. That is, the above operation of opening the door unit 50 results in a simultaneous opening of the entire section of the paper transfer path 60, and thus a user is able to remove jammed sheets of paper at any position along the paper transfer path 60 at which the jamming occurs, for example, at the J1 and J2 locations illustrated in FIG. 2.

After the jammed sheets of paper at different locations along the paper transfer path 60 (such as J1 and J2) are removed, the user can close the door unit 50. When the door unit 50 is locked to the main body frame 12, the pressurizing protrusion 55 installed at the inner side of the door unit 50 pushes the sliding member 82 inwardly. An arrow B in FIG. 2 represents this inwardly applied pressure. Because of this inward applied pressure, the rotation member 84 connected with the sliding member 82 rotates in a clockwise direction, i.e., in a direction of an arrow D as illustrated in FIG. 2. As a result of this clockwise rotation, the rotation member 84 pushes the roller assembly 36 to engage with the paper discharge roller 31.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a main body frame;

an image forming unit disposed inside of the main body frame to form an image;

a door unit disposed to make a conjoint rotation to thereby approach a paper transfer path disposed inside of the main body frame;

a roller assembly disposed on the paper transfer path; and an opening and closing coupling unit to couple the door unit with the roller assembly, wherein the roller assembly is opened/closed when the door unit is opened/closed.

2. The image forming apparatus of claim 1, wherein the door unit is disposed at a sidewall of the main body frame.

3. The image forming apparatus of claim 2, wherein the opening and closing coupling unit comprises:

a sliding member to slide in a horizontal direction; and a rotation member connected with the sliding member to make a conjoint rotation in a vertical direction.

4. The image forming apparatus of claim 3, wherein the rotation member comprises:

a horizontal rotation bar connected with the sliding member; and a vertical rotation bar in contact with the roller assembly.

5. The image forming apparatus of claim 2, further comprising:

a return unit disposed at an inner wall of the door unit to return a sheet of paper to be printed on both sides.

6. The image forming apparatus of claim 5, wherein the return unit has an integral structure with the door unit.

7. The image forming apparatus of claim 5, further comprising:

a pressurizing protrusion disposed on the inner wall of the door unit to pressurize the opening and closing coupling unit.

8. The image forming apparatus of claim 7, further comprising:

a hinge unit to connect the roller assembly with the main body frame therethrough and to pressurize the opening and closing coupling unit by a load.

9. An image forming apparatus comprising:

a body;

a paper transfer path comprising a substantially inclined segment and a substantially horizontal segment to feed a recording medium therethrough;

a body door to open and close conjointly with the body to expose the substantially inclined segment of the paper transfer path; and an opening and closing unit to expose the substantially horizontal segment of the paper transfer path when the body door is opened.

10. The image forming apparatus of claim 9, wherein:

the substantially horizontal segment comprises a paper discharging roller and an assembly to form a portion of the paper transfer path with the paper discharge roller; and the opening and closing unit comprises a horizontal sliding member to move in a horizontal direction toward the body door when the body door is opened, and a connecting member movably connected to the horizontal sliding member to control the assembly of the horizontal segment to be spaced apart from the paper discharging roller to expose the portion of the paper transfer path.

11. The image forming apparatus of claim 10, wherein the opening and closing unit further comprises:

at least one guiding unit including at least one pair of idle rollers disposed above and bellow the horizontal sliding member, to guide the horizontal sliding member.

12. The image forming apparatus of claim 10, wherein the connecting member supports a paper-discharge roller assembly disposed below the substantially horizontal segment of the paper transfer path, and when the horizontal sliding member moves towards the body door, the contacting member lowers the paper-discharge roller assembly.

13. The image forming apparatus as in claim 12, the connecting member comprising:

a first bar connected to the horizontal sliding member and to a fixed joint such that the first bar rotates when the sliding member moves; and a second bar connected to the first bar in the fixing joint and having a constant angle with the first bar so that the second bar rotates when the first bar rotates.

14. The image forming apparatus of claim 9, further comprising:

a paper return path comprising a second substantially inclined segment and a second substantially horizontal segment that joins with the substantially horizontal segment of the paper transfer path, wherein the recording medium is fed therein after being printed on one side to reverse the recording medium to be printed on the other side; and a return unit to guide the recording medium along the paper return path.

15. The image forming apparatus as claimed in claim 9, further comprising:

a pressurizing protrusion extending from the body door to control the opening and closing unit inside the body when the body door is closed.

16. An image forming apparatus housing, comprising:

a paper transfer path having a substantially inclined portion to feed a recording medium from a lower portion of the housing to an upper portion of the housing and a substantial horizontal portion;

a door to open conjointly with the housing to expose the substantially inclined portion of the paper transfer path; and a roller assembly unit that rotates to expose the substantially horizontal portion of the paper transfer path when the door is opened.

17. The image forming apparatus housing of claim 16, further comprising:

an opening and closing coupling unit having a first end in contact with the door and a second end in contact with the roller assembly unit such that when the door is opened the opening and closing coupling unit slides a predetermined distance toward the door while allowing the roller assembly to pivot away from the substantially horizontal portion of the paper path.

18. The image forming apparatus housing of claim 17, wherein the opening and closing coupling unit includes a sliding member to slide in association with the door and a rotation member connected to the second end thereof to rotate in a first direction when the door is opened and in a second direction when the door is closed to control positioning of the roller assembly.

19. An image forming apparatus having a plurality of paper transfer paths, comprising:

a plurality of exposing members to expose an associated one of the paper transfer paths; and an opening and closing unit to operate at least one of the plurality of exposing members to expose the associated one of the plurality of paper transfer paths when another one of the plurality of exposing members is operated to expose the associated one of the plurality of paper transfer paths.

20. A method of exposing a paper transport path of an image forming apparatus, the method comprising:

opening a body door to expose a substantially inclined segment of the paper transfer path; and exposing a substantially horizontal segment of the paper transfer path by moving an opening and closing unit when the body door is open.

* * * * *